US007913525B2

(12) United States Patent
Ma

(10) Patent No.: US 7,913,525 B2
(45) Date of Patent: Mar. 29, 2011

(54) POINTER PADLOCK

(76) Inventor: Sam Ma, Changhua County (TW)

( * ) Notice: Subject to any disclaimer, the term of this patent is extended or adjusted under 35 U.S.C. 154(b) by 539 days.

(21) Appl. No.: 12/060,472

(22) Filed: Apr. 1, 2008

(65) Prior Publication Data

US 2009/0113948 A1 May 7, 2009

(51) Int. Cl.
*E05B 37/06* (2006.01)

(52) U.S. Cl. ..... 70/25; 70/312; 70/315; 70/250

(58) Field of Classification Search ..... 70/250, 70/284, 285, 312, 315, 304, 305, 26, 27, 70/21, 22

See application file for complete search history.

(56) References Cited

U.S. PATENT DOCUMENTS

| | | | | | |
|---|---|---|---|---|---|
| 345,340 | A * | 7/1886 | Volke | 70/25 |
| 372,498 | A * | 11/1887 | Spivey | 70/315 |
| 610,424 | A * | 9/1898 | Wible | 70/28 |
| 904,182 | A * | 11/1908 | Orim | 70/27 |
| 974,636 | A * | 11/1910 | Blaszozyk | 70/303 R |
| 1,102,167 | A * | 6/1914 | Radaszewski | 70/26 |
| 1,287,435 | A * | 12/1918 | Rega | 70/213 |
| 1,662,694 | A * | 3/1928 | Bartmess | 70/27 |
| 1,696,061 | A * | 12/1928 | Soley | 70/26 |
| 1,994,960 | A * | 3/1935 | Poderzaj | 70/312 |
| 2,271,204 | A * | 1/1942 | Peters | 70/58 |
| 2,272,689 | A * | 2/1942 | Ezio | 70/312 |
| 2,830,447 | A * | 4/1958 | Miller | 70/319 |
| 3,008,321 | A * | 11/1961 | Gonzalez | 70/74 |
| 4,014,193 | A * | 3/1977 | Carter | 70/288 |
| 4,476,698 | A * | 10/1984 | Treslo | 70/25 |
| 6,470,717 | B1 * | 10/2002 | Yu | 70/25 |
| 7,694,541 | B2 * | 4/2010 | Shum | 70/25 |
| 2008/0173049 | A1 * | 7/2008 | Burmesch et al. | 70/25 |

* cited by examiner

*Primary Examiner* — Suzanne D Barrett

(74) *Attorney, Agent, or Firm* — Browdy and Neimark, PLLC

(57) ABSTRACT

A padlock includes a housing, a shackle having a pivoting portion pivotally passing through a first top hole of the housing into an accommodation chamber of the housing and a locking end passing through a second top hole of the housing, a retaining device disposed in the accommodation chamber and having at least two driving wheels for controlling an axial movement of the pivoting portion of the shackle, and at least two pointers located above a dial of the housing and respectively driven by the driving wheels to point to one of figures of the dial. When both of the pointers point to correct figures, the pivoting portion of the shackle is axially moveable relative to the housing under the control of the driving wheels, such that locking end of the shackle is moveable away from the second top hole of the housing to unlock the padlock.

19 Claims, 7 Drawing Sheets

POINTER PADLOCK

BACKGROUND OF THE INVENTION

1. Field of the Invention

The present invention relates generally to locks, and more specifically to a pointer padlock that provides a safety burglarproof effect.

2. Description of the Related Art

Conventional locks generally include a key controlled lock, which needs a correct key to unlock it, and a combination controlled lock, which needs a correct permutation of numbers or symbols to unlock it.

When a user would like to buy a lock, the burglarproof effect of the lock is the most important concern for the user. As far as the combination controlled lock is concerned, it can provide better burglarproof effect than the key controlled lock by means of rotating numbered wheels to show the correct permutation of numbers or symbols. However, the conventional combination controlled lock generally has three or four numbered wheels and therefore the permutation of numbers is finite and may be easily unscrambled by someone. If the number of the numbered wheels is increased, the permutation of numbers showed by the numbered wheels will be too complex to be remembered by the user and the structure of the combination controlled lock will be too complicated, limiting the outline design of the combination controlled lock.

SUMMARY OF THE INVENTION

The present invention has been accomplished in view of the above-noted circumstances. It is one objective of the present invention to provide a padlock, which has pointers to provide a safety burglarproof effect.

To achieve this objective of the present invention, the padlock comprises a housing, a shackle, a retaining device, and at least two pointers. The housing has an accommodation chamber, a first top hole in communication with the accommodation chamber, a second top hole in communication with the accommodation chamber, and a dial mounted on a top side thereof and provided with a plurality of figures. The shackle has a pivoting portion pivotally passing through the first top hole of the housing into the accommodation chamber of the housing and axially movable relative to the housing, and a locking end insertable into the second top hole of the housing. The retaining device is disposed in the accommodation chamber of the housing and has at least two driving wheels for controlling an axial movement of the pivoting portion of the shackle. The pointers are located above the dial of the housing and respectively driven by the driving wheels of the retaining device to point to one of the figures. When both of the pointers point to correct figures, the pivoting portion of the shackle is axially moveable relative to the housing under the control of the driving wheels of the retaining device, such that the locking end of the shackle is moveable away from the second top hole of the housing to unlock the padlock.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
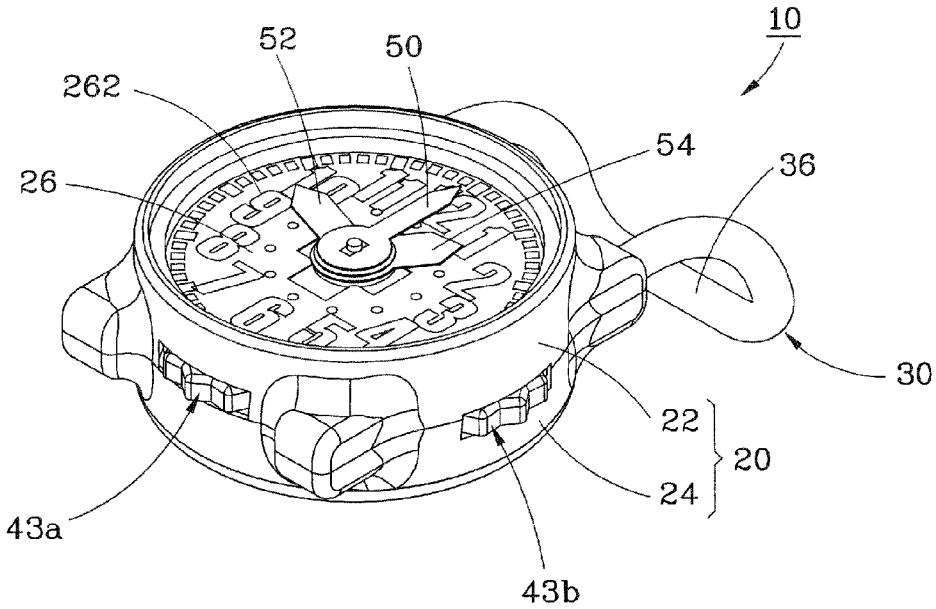
FIG. 1 is a perspective view of a padlock according to a preferred embodiment of the present invention.
Figure 3:
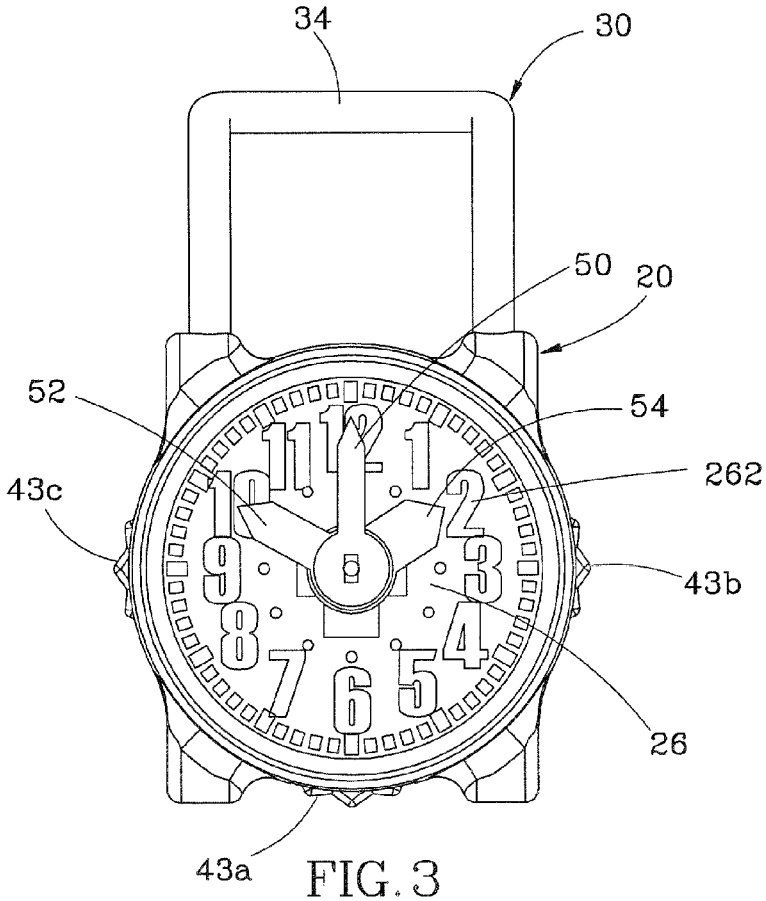
FIG. 3 is a front view of the padlock according to the preferred embodiment of the present invention.
Figure 2:
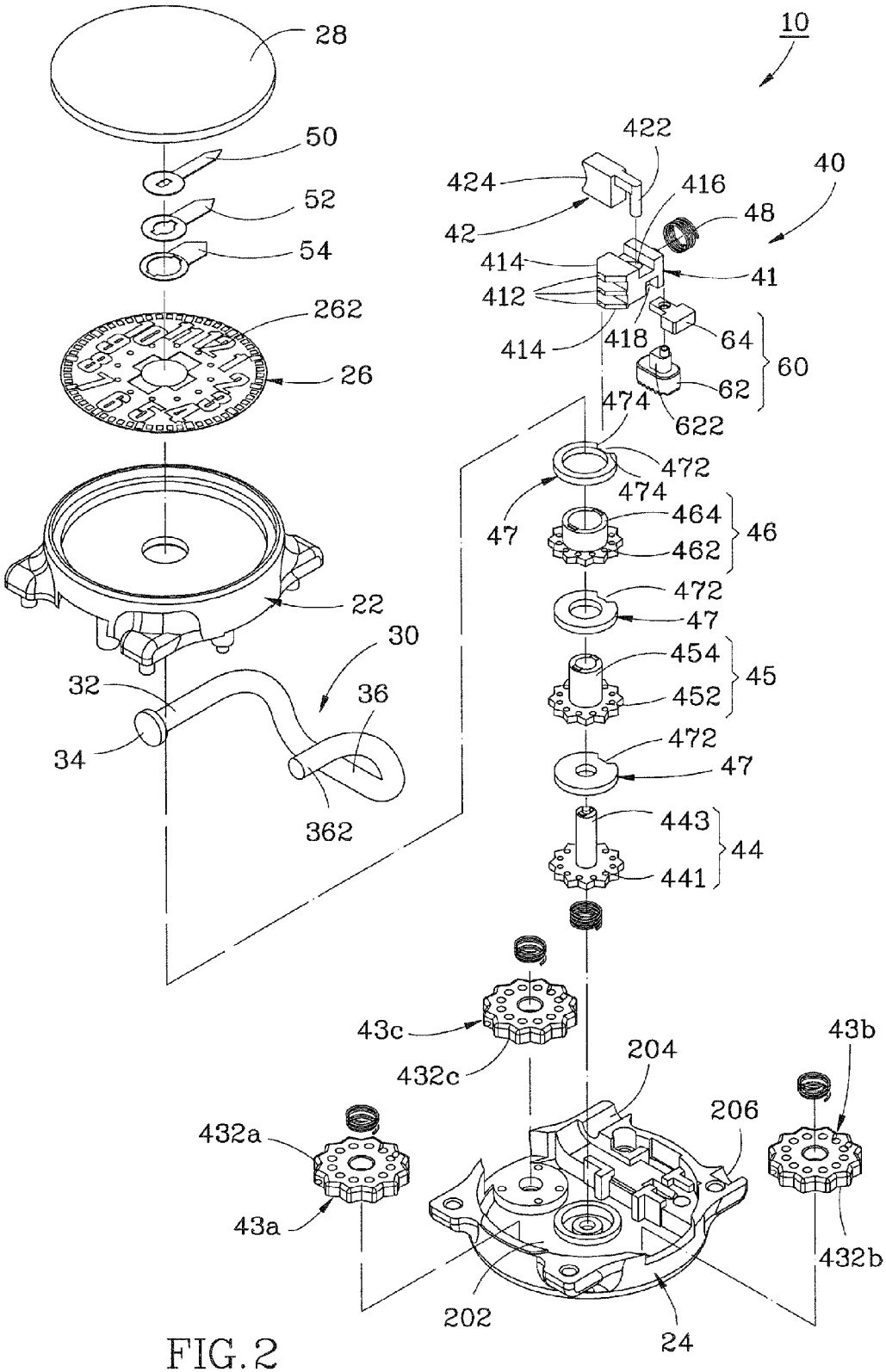
FIG. 2 is an exploded view of the padlock according to the preferred embodiment of the present invention.

Referring to FIGS. 1 to 3, a padlock 10 in accordance with a preferred embodiment of the present invention comprises a housing 20, a shackle 30, a retaining device 40, a first pointer 50, a second pointer 52, a third pointer 54, and an adjusting member 60.

The housing 20 includes a top lid 22 and a base 24 coupled to the top lid 22 so as to define an accommodation chamber 202, a first top hole 204 in communication with the accommodation chamber 202, and a second top hole 206 in communication with the accommodation chamber 202. The housing 20 has a dial 26 mounted on a top side of the top lid 22 and provided with a plurality of figures 262, which are embodied as Arabic numerals 1 to 12 in this embodiment, and a transparent cover 28 covered on the dial 26.

The housing 30 has a pivoting portion 32 passing through the first top hole 204 of the housing 20 into the accommodation chamber 202 of the housing 20 and axially movable and pivotable relative to the housing 20, a block portion 34 provided at a bottom end of the pivoting portion 32, and a hook portion 36 integrally connected with the pivoting portion 32 and having a locking end 362 insertable into the second top hole 206 of the housing 20.

The retaining device 40 includes a latch 41, a block member 42, three driving wheels 43*a*-43*c*, a first transmission wheel 44, a second transmission wheel 45, a third transmission wheel 46, three retaining wheels 47, and an elastic member 48.

Figure 4:
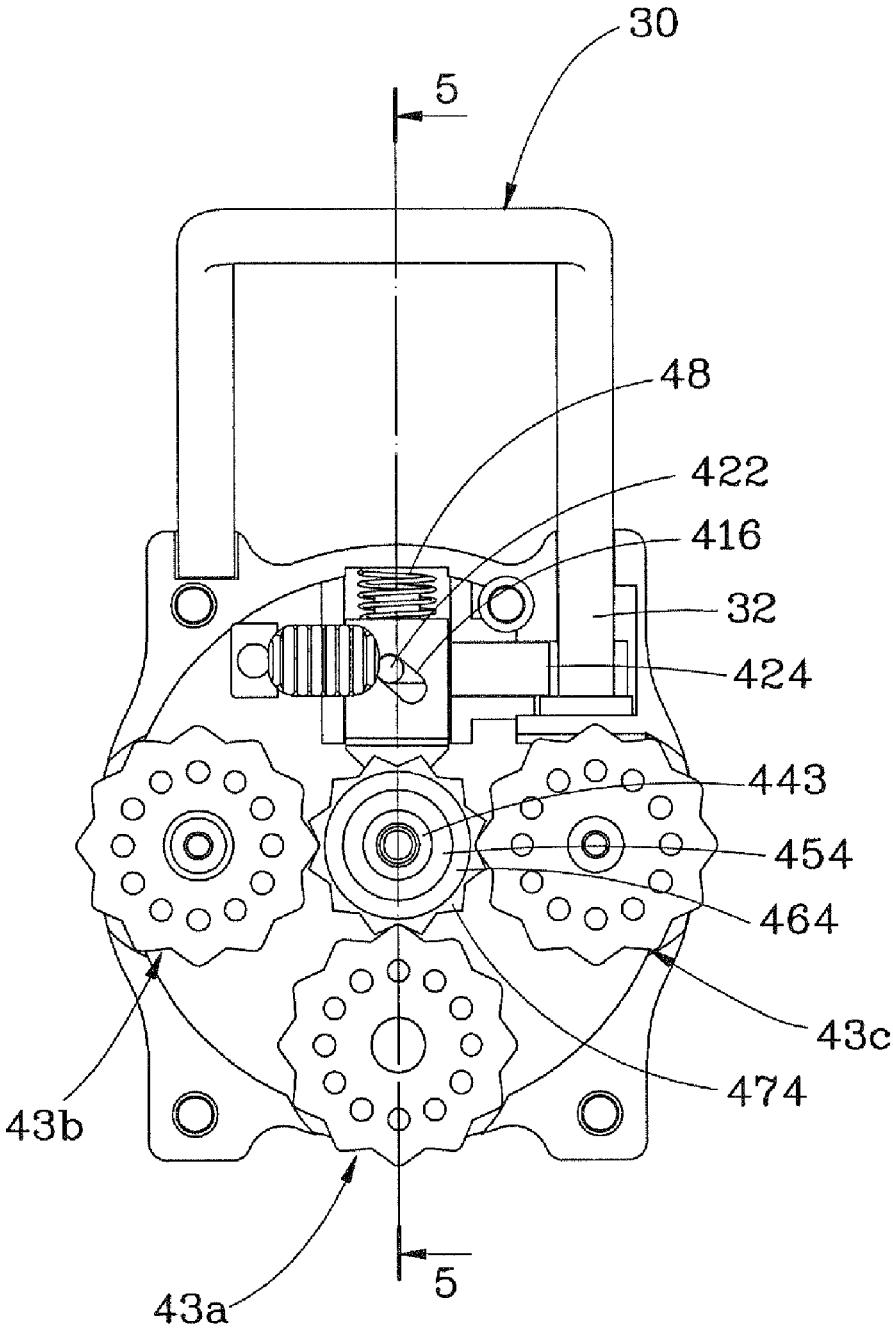
FIG. 4 is a rear view of the padlock according to the preferred embodiment of the present invention, in which the base is removed.

The latch 41 is mounted in the accommodation chamber 202 of the housing 20 and movable relative to the housing 20. The latch 41 is provided at a bottom thereof with three insertion portions 412, each of which is formed as a trapezoid having two first beveled surfaces 414, as shown in FIG. 2. The latch 41 further includes an inclined groove 416 at a middle thereof with a top end defining with the pivoting portion 32 of the shackle 30 a distance that is longer than a distance defined between a bottom end of the inclined groove 416 and the pivoting portion 32 of the shackle 30, as shown in FIG. 4, and a recess 418 at a rear side thereof.

Figure 6:
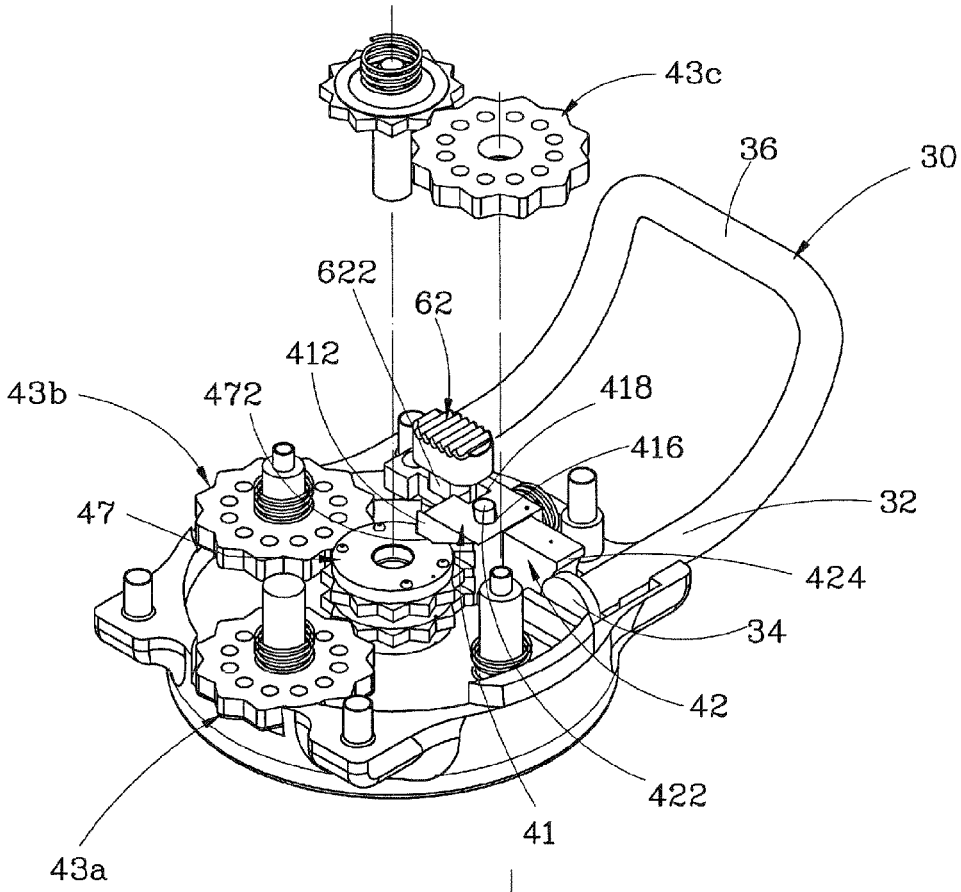
FIG. 6 is a partial exploded view of the padlock according to the preferred embodiment of the present invention, showing the padlock is unlocked.
Figure 7:
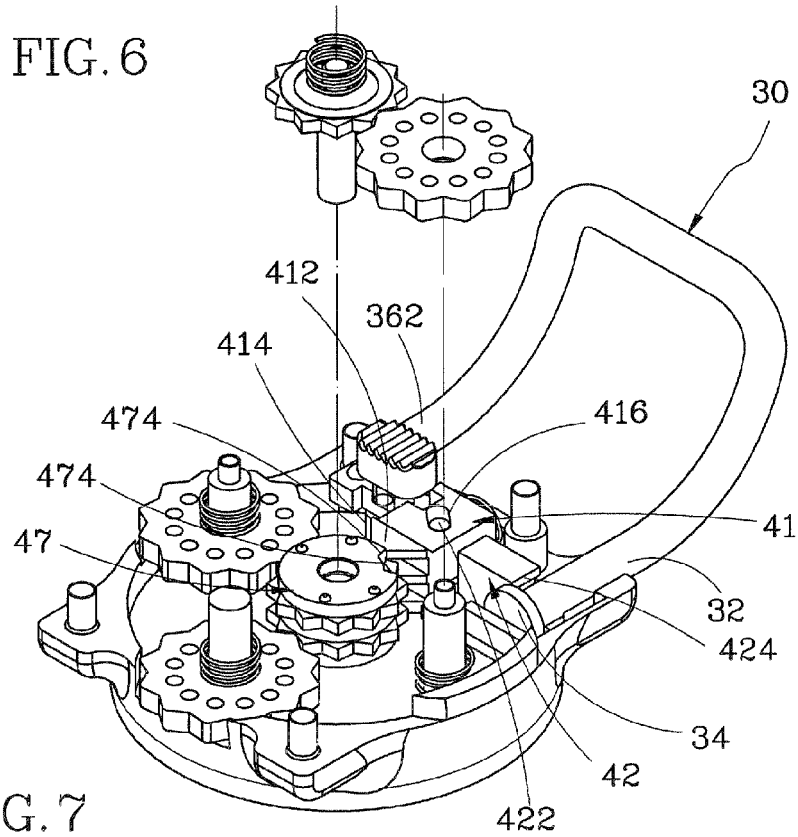
FIG. 7 is a partial exploded view of the padlock according to the preferred embodiment of the present invention, showing the padlock is locked.

The block member 42 has a block end 424 and a connection end 422 inserted into the inclined groove 416 of the latch 41 and slidable between the two ends of the inclined groove 416 of the latch 41, as shown in FIGS. 6 and 7, such that the block end 424 can approach or leave the pivoting portion 32 of the shackle 30.

The driving wheels 43*a*-43*c* are rotatably mounted in the accommodation chamber 202 of the housing 20 and partially extend out of the housing 20 for user's operation. Each of the driving wheels 43*a*-43*c* has twelve indentations 432*a*-432*c* on the periphery thereof.

Figure 5:
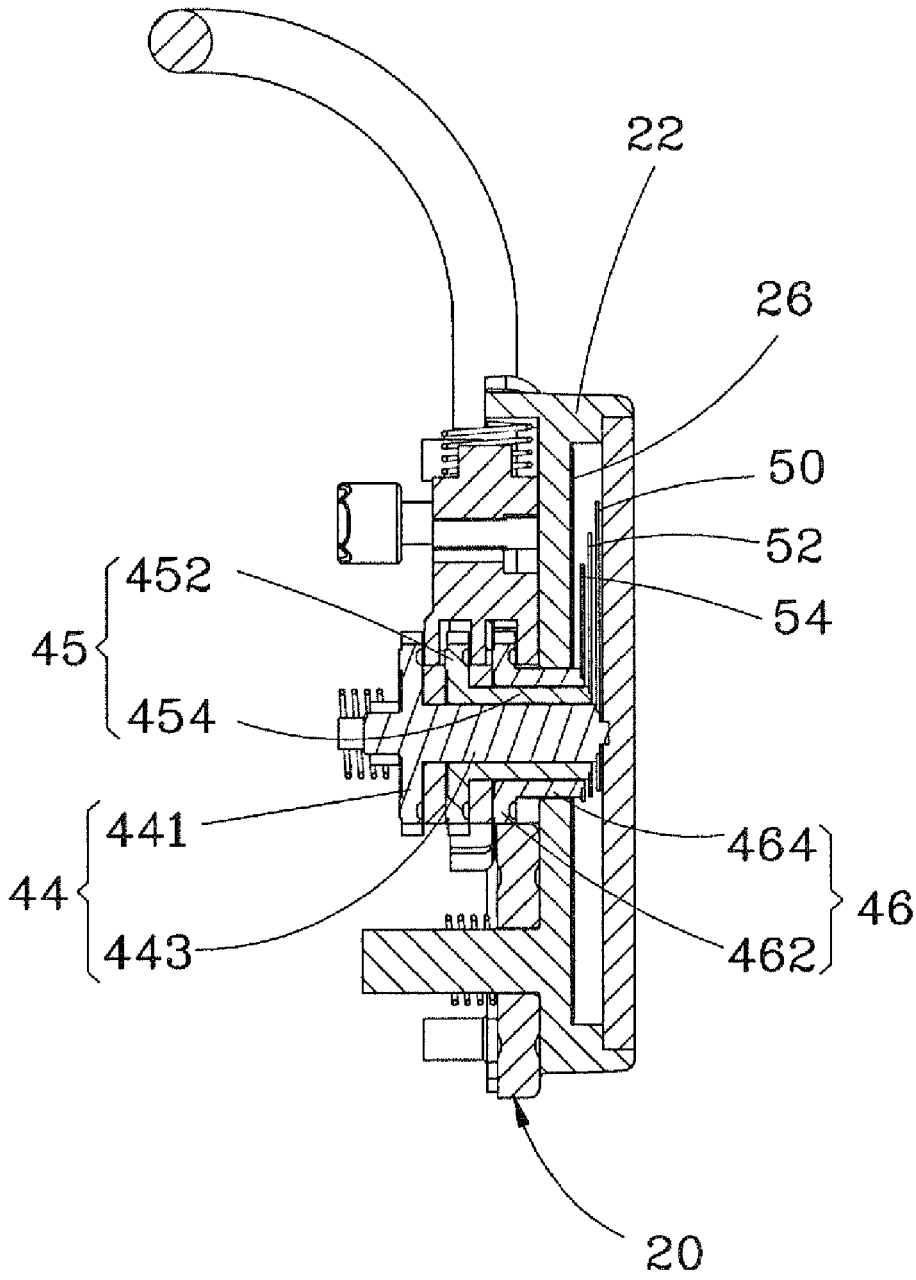
FIG. 5 is a sectional view taken along line 5-5 of FIG. 4.

The first transmission wheel 44 has a first gear 441 engaged with the indentation 432*a* of the driving wheel 43*a* such that the first transmission wheel 44 can be driven by the driving wheel 43*a* to rotate and a first shaft 443 extending from a center of the first gear 441, as shown in FIG. 2, and penetrating through the top lid 22 of the housing 20 and projecting out of the dial 26 of the housing 20, as shown in FIG. 5.

The second transmission wheel 45 has a second gear 452 engaged with the indentations 432*b* of the driving wheel 43*b* such that the second transmission wheel 45 can be driven by the driving wheel 43*b* to rotate, and a second shaft 454 coaxially sleeved onto the first shaft 443 of the first transmission wheel 44 and penetrating through the top lid 22 of the housing 20 and projecting out of the dial 26 of the housing 20. The second shaft 454 is shorter in length than the first shaft 443 such that a distal end of the first shaft 443 is protruded out of a distal end of the second shaft 454, as shown in FIG. 5.

The third transmission wheel 46 has a third gear 462 engaged with the indentation 432*c* of the driving wheel 43*c* such that the third transmission wheel 46 can be driven by the driving wheel 43*c* to rotate, and a third shaft 464 coaxially sleeved onto the second shaft 454 of the second transmission wheel 45 and penetrating through the top lid 22 of the housing 20 and projecting out of the dial 26 of the housing 20. The third shaft 464 is shorter in length than the second shaft 454 such that a distal end of the second shaft 454 is protruded out of a distal end of the third shaft 464, as shown in FIG. 5.

The retaining wheels 47 are respectively sleeved onto the first shaft 443 of the first transmission wheel 44, the second shaft 454 of the second transmission wheel 45, and the third shaft 464 of the third transmission wheel 46 so as to be respectively rotated with the first transmission wheel 45, the second transmission wheel 46, and the third transmission wheel 47. Each retaining wheel 47 has a notch 472 with two second beveled surfaces 474 matched up with the first beveled surfaces 414 of the latch 41.

The elastic member 48 is mounted in the accommodation chamber 202 of the housing 20 and has two ends respectively stopped against a periphery of the accommodation chamber 202 of the housing 20 and the latch 41 for providing an elastic force to push the latch 41 toward the retaining wheels 47.

The first pointer 50, the second pointer 52, and the third pointer 54 are respectively connected to the first shaft 443 of the first transmission wheel 44, the second shaft 454 of the second transmission wheel 45, and the third shaft 464 of the third transmission wheel 46 and located above the dial 26 of the housing 20, as shown in FIG. 5, such that the first pointer 50, the second pointer 52, and the third pointer 54 can be respectively driven by the first transmission wheel 44, the second transmission wheel 45, and the third transmission wheel 46 to point to one of the figures 262. When all of the first pointer 50, the second pointer 52, and the third pointer 54 point to predetermined correct figures 262, the insertion portions 412 of the latch 41 are inserted into the notches 472 of the retaining wheels 47, as shown in FIG. 6, such that the connection end 422 of the block member 42 moves to the top end of the inclined groove 416 of the latch 41 and the block end 424 of the block member 30 leaves the block portion 34 of the shackle 30, resulting in that the pivoting portion 32 of the shackle 30 can be axially moved and therefore the locking end 362 of the shackle 30 can be moved away from the second top hole 206 of the housing 20 to unlock the padlock 10. On the contrary, when one of the first pointer 50, the second pointer 52, and the third pointer 54 points to an incorrect figure 262, the insertion portions 412 of the latch 41 and the notches 472 of the retaining wheels 47 are staggered, as shown in FIG. 7, such that the connection end 422 of the block member 42 moves to the bottom end of the inclined groove 416 of the latch 41 and the block end 424 of the block member 42 blocks the block portion 34 of the shackle 30, resulting in that the pivoting portion 32 of the shackle 30 cannot be axially moved and therefore the locking end 362 of the shackle 30 cannot be moved away from the second top hole 206 of the housing 20.

Figure 9:
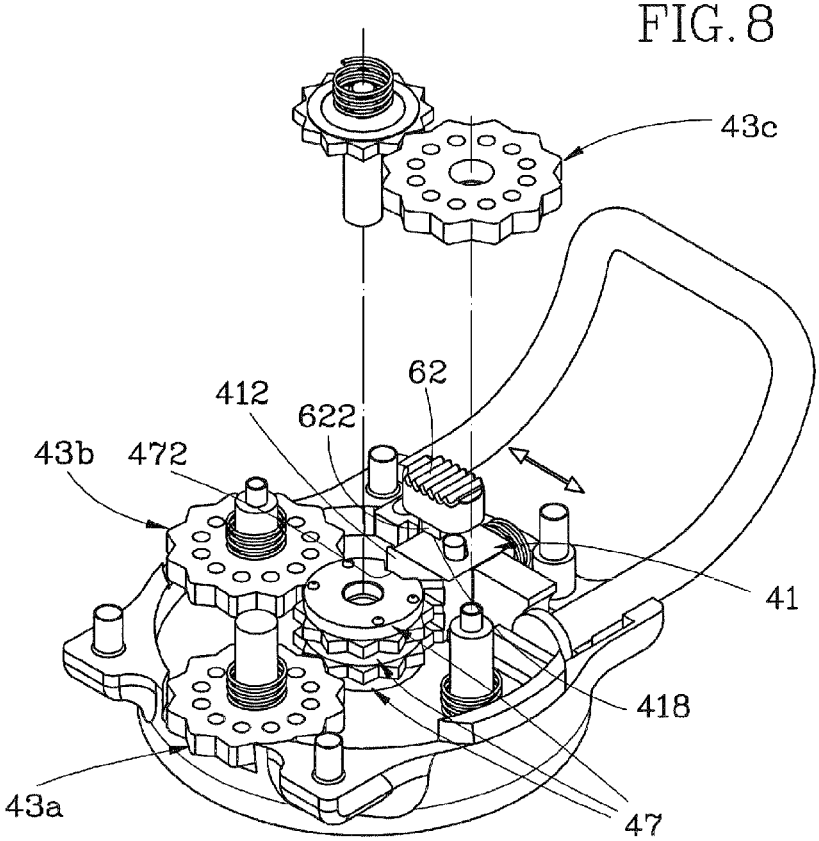
FIG. 9 is a partial exploded view of the padlock according to the preferred embodiment of the present invention, showing the protrusion of the tab is engaged with the recess of the latch.

The adjusting member 60 is mounted in the accommodation chamber 202 of the housing 20, including a tab 62 and a linking member 64, as shown in FIG. 2. The tab 62 has a protrusion 622 coupled to the linking member 64 and a bottom side exposed out of the base 24 of the housing 20 for enabling the tab 62 to be driven by an external force to make the adjusting member 60 move between a first position where the protrusion 622 of the tab 62 is disengaged from the recess 418 of the latch 41, as shown in FIG. 6, and therefore the latch 41 can be moved upwards, and a second position where the protrusion 622 of the tab 62 is engaged with the recess 418 of the latch 41, as shown in FIG. 9, and therefore the latch 41 cannot be moved upwards When a user would like to unlock the padlock 10 and the code to unlock the padlock 10 is set to two o'clock and fifty minutes as an example, he/she can rotate the driving wheel 43*c* to move the third pointer 54 to point to Arabic numeral 2 through the third transmission wheel 46, and then rotates the driving wheel 43*b* to move the second pointer 52 to point to Arabic numeral 10 through the second transmission wheel 45, and then rotates the driving wheel 43*a* to move the first pointer 50 to point to Arabic numeral 12, as shown in FIG. 3. As a result, the insertion portions 412 of the latch 41 are inserted into the notches 472 of the retaining wheels 47, as shown in FIG. 6, and the connection end 422 of the block member 42 moves to the top end of the inclined groove 416 of the latch 41 such that the block end 424 of the block member 30 leaves the block portion 34 of the shackle 30. Therefore, the user can pull upwards the hook portion 36 of the shackle 30 to enable the locking end 362 of the shackle 30 to leave the second top hole 206 of the housing 20 and enable the pivoting portion 32 of the shackle 30 to pivot relative the housing 20, thereby unlocking the padlock 10.

When the user would like to lock the padlock 10, he/she can press the hook portion 36 of the shackle 30 to make the locking end 362 of the shackle 30 insert into the second top hole 206 of housing 20, and then rotates the driving wheels 43*a*-43*c* to drive the retaining wheels 47 to rotate. At this time, the second beveled surfaces 474 of the notches 472 of the retaining wheels 47 will push upwards the first beveled surfaces 414 of the insertion portions 412 of the latch 41 to force the insertion portions 412 of the latch 41 to leave the notches 472 of the retaining wheels 47, as shown in FIG. 7. Accordingly, the block member 42 will approach the block portion 34 of the shackle 30 such that the connection end 422 of the block member 42 moves to the bottom end of the inclined groove 416 of the latch 41 and the block end 424 of the block member 42 blocks the block portion 34 of the shackle 30, resulting in that the pivoting portion 32 of the shackle 30 cannot be axially movable.

Figure 8:
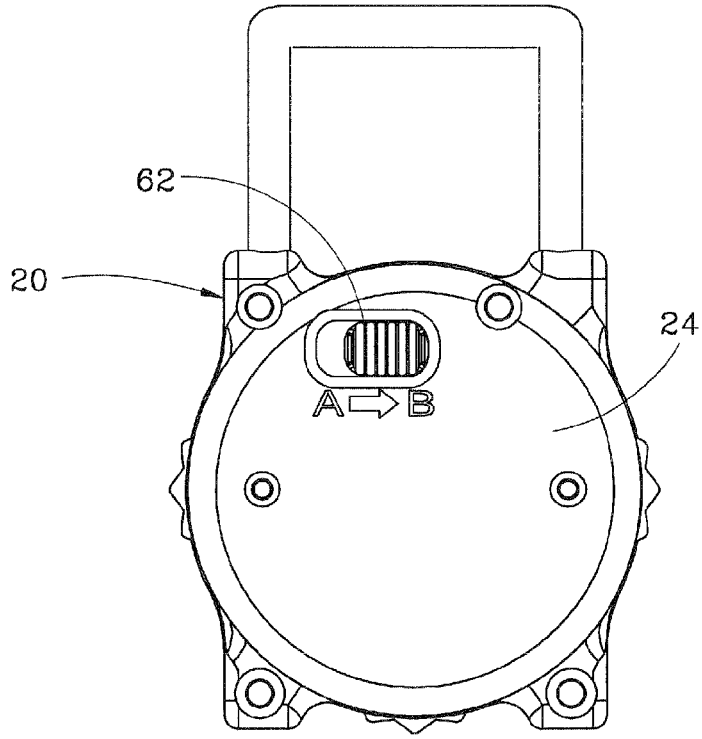
FIG. 8 is a rear view of the padlock according to the preferred embodiment of the present invention, showing the tab is located at the second position.

The code to unlock the padlock 10 can be changed according to the user's requirement. In the code changing processes, the user can rotate the driving wheels 43*a*-43*c* to move the first pointer 50, the second pointer 52, and the third pointer 54 to point to the previously set correct figures 262 first for enabling the insertion portions 412 of the latch 41 to be inserted into the notches 472 of the retaining wheels 47, and then forces the tab 62 to move to the second position where the protrusion 622 of the tab 62 is engaged with the recess 418 of the latch 41, as shown in FIG. 8 and FIG. 9, and then rotates the driving wheels 43*a*-43*c* to drive the first transmission wheel 44, the second transmission wheel 45, and the third transmission wheel 46 to rotate. At this time, the retaining wheels 47 cannot force the latch 41 to move upwards due to the engagement of the protrusion 622 and the recess 418 and cannot be rotated with the first transmission wheel 44, the second transmission wheel 45, and the third transmission wheel 46 due to the engagement of the insertion portions 412 and the notches 472. In this situation, when the driving wheels 43*a*-43*c* are rotated, the first transmission wheel 44, the second transmission wheel 45, and the third transmission wheel 46 will run idly relative to the retaining wheels 47. Therefore, as long as the user rotates the driving wheels 43*a*-43*c* to move the first pointer 50, the second pointer 52, and the third pointer 54 to set a new code and then forces the tab 62 to move to the first position, the code changing process of the padlock 10 is completed.

Figure 10:
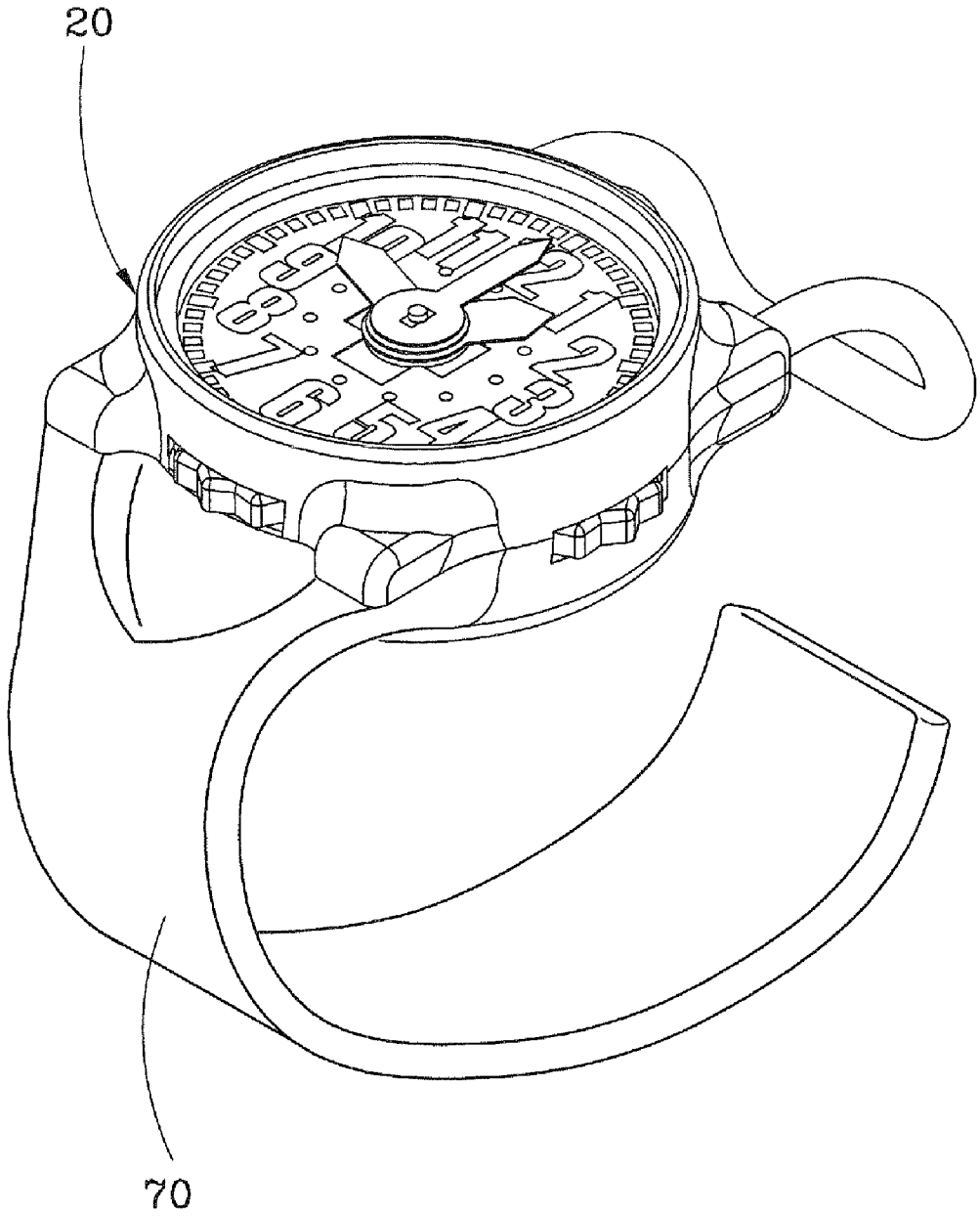
FIG. 10 is a perspective view of the padlock according to the preferred embodiment of the present invention, showing a band is connected with the housing.

As shown in FIG. 10, the padlock 10 can include a band 70 with one end connected with a bottom of the housing 20 and the other end curvedly extending such that the padlock 10 can be worn on the user's wrist for convenience of use and decoration.

By means of the aforesaid design, the padlock is designed as a watch, i.e. the first pointer, the second pointer, and the third pointer are respectively regarded as a second hand, a minute hand, and an hour hand. Thus, the user has to rotate all of the pointers to point to the correct time for unlocking the padlock such that the padlock of the invention has a safety burglarproof effect and uncomplicated structure. Besides, the padlock of the invention can be made like an alarm clock or a bomb as long as the padlock can be unlocked by rotating the pointers. In addition, the padlock of the invention can be made with various kinds of design. For example, the number of the driving wheels, the transmission wheels, and the retaining wheels is not limited to the above-mentioned embodiment as long as the driving wheels, the transmission wheels, and the retaining wheels are equivalent in amount. Further, the figures are not limited to Arabic numerals but can be presented in English letters or other symbols.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A padlock comprising:

a housing having an accommodation chamber, a first top hole in communication with the accommodation chamber, a second top hole in communication with the accommodation chamber, and a dial on a top side thereof, which is provided with a plurality of figures;

a shackle having a pivoting portion pivotally passing through the first top hole of the housing into the accommodation chamber of the housing and axially movable relative to the housing, and a locking end insertable into the second top hole of the housing;

a retaining device disposed in the accommodation chamber of the housing and having at least two driving wheels for controlling an axial movement of the pivoting portion of the shackle; and at least two pointers located above the dial of the housing and respectively driven by the driving wheels of the retaining device to point to one of the figures, whereby when both of the pointers point to correct figures, the pivoting portion of the shackle is axially moveable relative to the housing under the control of the driving wheels of the retaining device, such that the locking end of the shackle is movable away from the second top hole of the housing, thereby unlocking the padlock.

2. The padlock as claimed in claim 1, wherein the retaining device further includes a latch movably mounted in the accommodation chamber of the housing and provided with at least two insertion portions, a block member connected to the latch so as to be driven by the latch to move relative to the pivoting portion of the shackle, at least two transmission wheels coaxially arranged in the accommodation chamber, and respectively engaged with the driving wheels and coupled to the pointers such that the transmission wheels are respectively driven by the driving wheels to drive the pointers to rotate, and at least two retaining wheels respectively coaxially connected with the transmission wheels so as to be rotated with the transmission wheels; the two retaining wheels each having a notch; wherein the two retaining wheels are arranged in such a way that when both of the pointers are respectively point to the correct figures, the insertion portions of the latch are inserted into the notches of the retaining wheels such that the block member is driven by the latch to move away from the pivoting portion of shackle, resulting in that the pivoting portion of the shackle is axially movable relative to the housing, and when one of the pointers points to an incorrect figure, the insertion portions of the latch are departed from the notches of the retaining wheels such that the block member is driven by the latch to block the pivoting portion of the shackle, resulting in that the pivoting portion is axially immovable relative to the housing.

3. The padlock as claimed in claim 2, wherein each of said transmission wheels of the retaining device includes a gear engaged with one of the driving wheels and a shaft coaxially extending from the gear and passing through the dial of the housing for connection with one of the pointers; wherein the shaft of one of the transmission wheels is sleeved onto the shaft of the other transmission wheels.

4. The padlock as claimed in claim 2, wherein the shackle has a block portion at a bottom end of the pivoting portion of the shackle and blockable by the block member of the retaining device.

5. The padlock as claimed in claim 2, wherein the latch of the retaining device has an inclined groove with a top end defining with the pivoting portion of the shackle a distance that is longer than a distance defined between a bottom end of the inclined groove and the pivoting portion of the shackle, and the block member has a block end and a connection end inserted into the inclined groove of the latch and movable between the two ends of the inclined groove for enabling the block end to approach or leave the pivoting portion of the shackle.

6. The padlock as claimed in claim 2, wherein the retaining device further includes an elastic member mounted in the accommodation chamber of the housing and having two ends respectively stopped against a periphery wall of the accommodation chamber of the housing and the latch of the retaining device.

7. The padlock as claimed in claim 2, further comprising an adjusting member movably mounted in the accommodation chamber of the housing and movable relative to the latch between a first position where the adjusting member is disengaged from a recess of the latch and a second position where the adjusting member is engaged with the recess of the latch.

8. The padlock as claimed in claim 7, wherein the adjusting member has a tab with a protrusion disengaged from the recess of the latch when the adjusting member is located at the first position and engaged with the recess of the latch when adjusting member is located at the second position.

9. The padlock as claimed in claim 1, further comprising a band with one end connected with a bottom of the housing and the other end curvedly extending.

10. The padlock as claimed in claim 2, comprising three said pointers; the retaining device comprises three said driving wheels and three said transmission wheels respectively engaged with the driving wheels and connected with the pointers.

11. A padlock comprising:

a housing having an accommodation chamber, a first top hole in communication with the accommodation chamber, a second top hole in communication with the accommodation chamber, and a dial with figures;

a shackle having a pivoting portion pivotally passing through the first top hole of the housing into the accommodation chamber of the housing and axially movable relative to the housing, and a locking end insertable into the second top hole of the housing;

a latch movably mounted in the accommodation chamber of the housing and provided with at least two insertion portions;

a block member connected to the latch and drivable by the latch to move relative to the pivoting portion of the shackle, at least two driving wheels respectively and rotatably mounted in the accommodation chamber of the housing;

at least two transmission wheels coaxially arranged in the accommodation chamber of the housing and engaged with the driving wheels respectively;

at least two pointers located above the dial and coupled to the transmission wheels respectively such that the pointers are drivable by the driving wheels through the transmission wheels to rotationally move for pointing one of the figures, and at least two retaining wheels each having a notch and respectively coaxially connected with the transmission wheels in such a way that the retaining wheels are rotatable along with the transmission wheels respectively, and when both of the pointers are respectively point to correct figures, the insertion portions of the latch are inserted into the notches of the retaining wheels such that the block member is driven by the latch to move away from the pivoting portion of shackle, resulting in that the pivoting portion of the shackle is axially movable relative to the housing and the locking end of the shackle is movable away from the second top hole of the housing to unlock the padlock, and when one of the pointers points to an incorrect figure, the insertion portions of the latch are departed from the notches of the retaining wheels such that the block member is driven by the latch to block the pivoting portion of the shackle, resulting in that the pivoting portion is axially immovable relative to the housing.

12. The padlock as claimed in claim 11, wherein each of said transmission wheels of the retaining device includes a gear engaged with one of the driving wheels and a shaft coaxially extending from the gear and passing through the dial of the housing for connection with one of the pointers; wherein the shaft of one of the transmission wheels is sleeved onto the shaft of the other transmission wheels.

13. The padlock as claimed in claim 11, wherein the shackle has a block portion at a bottom end of the pivoting portion of the shackle and blockable by the block member of the retaining device.

14. The padlock as claimed in claim 11, wherein the latch of the retaining device has an inclined groove with a top end defining with the pivoting portion of the shackle a distance that is longer than a distance defined between a bottom end of the inclined groove and the pivoting portion of the shackle, and the block member has a block end and a connection end inserted into the inclined groove of the latch and movable between the two ends of the inclined groove for enabling the block end to approach or leave the pivoting portion of the shackle.

15. The padlock as claimed in claim 11, wherein the retaining device further includes an elastic member mounted in the accommodation chamber of the housing and having two ends respectively stopped against a periphery wall of the accommodation chamber of the housing and the latch of the retaining device.

16. The padlock as claimed in claim 11, further comprising an adjusting member movably mounted in the accommodation chamber of the housing and movable relative to the latch between a first position where the adjusting member is disengaged from a recess of the latch and a second position where the adjusting member is engaged with the recess of the latch.

17. The padlock as claimed in claim 16, wherein the adjusting member has a tab with a protrusion disengaged from the recess of the latch when the adjusting member is located at the first position and engaged with the recess of the latch when adjusting member is located at the second position.

18. The padlock as claimed in claim 1, further comprising a band with one end connected with a bottom of the housing and the other end curvedly extending.

19. The padlock as claimed in claim 11, comprising three said pointers; the retaining device comprises three said driving wheels and three said transmission wheels respectively engaged with the driving wheels and connected with the pointers.

* * * * *